US005518477A

United States Patent [19]

Simonson

[11] Patent Number: 5,518,477

[45] Date of Patent: May 21, 1996

[54] MULTI-STATION EXERCISE MACHINE WITH A COMMON WEIGHT STACK AND CABLE TENSION ISOLATION

[75] Inventor: Roy R. Simonson, Colorado Springs, Colo.

[73] Assignee: Lumex, Inc., Bay Shore, N.Y.

[21] Appl. No.: 191,662

[22] Filed: Feb. 4, 1994

[51] Int. Cl.[6] ..... A63B 21/16; A63B 21/06

[52] U.S. Cl. ..... 482/102; 482/100; 482/138; 254/399; 254/385

[58] Field of Search ..... 482/92–94, 97–103, 482/134, 137, 138, 100, 102; 254/385, 389, 390, 398, 399, 400; 242/155 R

[56] References Cited

U.S. PATENT DOCUMENTS

| | | | |
|---|---|---|---|
| 723,625 | 3/1903 | Thornley | 482/102 |
| 931,699 | 8/1909 | Medart | 482/102 |
| 2,463,394 | 3/1949 | King | 254/399 |
| 3,794,185 | 2/1974 | Kroll | 254/399 |
| 4,224,890 | 9/1980 | Johnson, Jr. | 254/399 |
| 4,505,475 | 3/1985 | Olschansky et al. | 482/138 |
| 4,744,559 | 5/1988 | Mahnke et al. | 482/99 |
| 4,809,972 | 3/1989 | Rasmussen et al. | 482/138 |
| 4,900,018 | 2/1990 | Ish et al. . | |
| 4,915,377 | 4/1990 | Malnke et al. . | |
| 4,986,538 | 1/1991 | Ish . | |
| 5,236,406 | 8/1993 | Webber | 482/99 |
| 5,263,915 | 11/1993 | Habing | 482/138 |
| 5,316,534 | 5/1994 | Dalebout et al. | 482/138 |
| 5,417,633 | 5/1995 | Habing | 482/97 |

*Primary Examiner*—Richard J. Apley
*Assistant Examiner*—Victor K. Hwang

[57] ABSTRACT

A cable and pulley system for a multi-station exercise machine involving a tensioned cable led over a series of pulleys, at least one of which is a cradled pulley normally nested in a cradle and radially held in the cradle by the force of the tension on the tensioned cable and radially movable out of the cradle by a greater force applied to the cradled pulley by a second pull cable mechanically connected to the cradled pulley and functioning to move the cradled pulley radially out of its cradle when sufficient tensional force is applied to the second cable to overcome the tension applied to the cradled pulley by the tensioned cable. Additional exercise stations can be added to operate with additional cables and cradled pulleys without changing the manner of operation of other cables and exercise stations.

20 Claims, 6 Drawing Sheets

MULTI-STATION EXERCISE MACHINE WITH A COMMON WEIGHT STACK AND CABLE TENSION ISOLATION

FIELD OF THE INVENTION

The present invention relates to exercise machines with multiple exercise stations and a cable and pulley system connecting the stations to a set of weights or so-called weight stack which can be operated from any of the exercise stations, such cable and pulley system providing that the pull cables to at least some of the exercise stations, although remaining connected in the cable and pulley system to the weight stack, are not under tension except when the associated exercise station is in use.

DESCRIPTION OF THE PRIOR ART

Multi-station exercise machines involving a set of weights or so-called weight stack for several exercise stations, and which involve cable and pulley systems wherein the pull cables to the respective exercise stations remain connected to the weight stack at all times, are known, such as disclosed in Ish et al U.S. Pat. No. 4,900,018 and Ish U.S. Pat. No. 4,986,538. However, in the cable and pulley systems of these and other prior multi-station exercise machines, such as shown schematically in FIG. 2 of U.S. Pat. No. 4,900,018 and in FIG. 6 of U.S. Pat. No. 4,986,538, the entire cable and pulley system of the machine connected to the weight stack is in tension any time the machine is being used at any one of the exercise stations. This is because the cables and pulleys leading from any one of the exercise stations to the weight stack include so-called floating pulleys about which certain of the pull cables from the respective exercise stations are reeved and interconnect. With the total length of cable involved in these prior cable and pulley systems being considerable, typically on the order of thirty feet or more, the tensioning on the cables under load throughout the system inherently causes a substantial amount of intermittent lengthening and shortening of the cables when a substantial amount of weight stack weight is being raised and lowered alternately and rapidly, a condition which is sometimes described as "bounce" and which is considered by users of these machines to be an irritant and distraction. Evident also is the fact that the continuing cyclic tensioning of the entire cable and pulley system of a multi-exercise machine with a single weight stack can cause more wear and need for earlier replacement than would otherwise be necessary with regard to the cables and pulleys and their associated system parts such as cable stops.

SUMMARY OF THE INVENTION

With the foregoing problems in mind, the present invention brings to the field of multi-station exercise equipment design an improved cable and pulley system concept which eliminates the need to have the entire cable and pulley system in tension whenever any one of the exercise stations is in use and which, moreover, has the capability of ease of design flexibility and ready adaptability to addition of further exercise stations to a given machine design, as desired.

More specifically, multi-station exercise machines operating a given weight stack, according to the present invention incorporate a pulley and cable system wherein a tensioned cable is led over a series of pulleys, at least one of which is a cradled pulley normally nested or seated in a stationary cradle support and radially held in the cradle by the force of the tension on the tensioned cable and radially movable out of the cradle by a greater force applied to the cradle pulley to move it away from the cradle, such greater force being applied to the cradled pulley by a second cable acting on the cradled pulley to move it radially out of its cradle and in turn cause movement of the portion of the tensioned cable between the cradled pulley and the weight stack responsive to movement of the second cable, such second cable being pulled from a selected exercise station. In practice of the invention, the tensioned cable reeved over one or more cradled pulleys and attached to the weight stack can be either pulled from a given exercise station such as a pressing station or can simply be anchored to the machine frame. With the tensioned cable attached to the weight stack and tension applied thereto, the pulling force from any of several exercise stations can be applied to lift an associated cradled pulley radially away from its cradle and thereby effect lifting of a selected number of weights from the weight stack. By this arrangement, only the cable led to the weight stack and the pull cable exerting a pull on the cradled pulley to lift it away from the cradle are under tension and any other cables in the system are not tensioned, thus greatly simplifying the portion of the overall cable and pulley system which is in operation during any given mode of use of the machine.

One advantage of cable and pulley systems for multi-station exercise machines according to the present invention is that such a pulley and cable system yields immediate and full application of resistance (the selected amount of free weight) without cable changes. Moreover, the system can provide 1:1 resistance (movement to weight ratio) without additional multiplying pulleys and the associated cabling otherwise necessary to obtain a desired resistance ratio.

As an advantage related to the minimizing of any "bounce" in an exercise machine's cable system, particularly when operating a machine's pressing station which normally calls for higher levels of resistance, the disclosed preferred form of machine here presented includes a pressing arm mounting arrangement involving a carriage and track and a resulting movement of the pressing arm parallel to itself, providing greater uniformity of resistance over the full range of arm movement as compared with other machines wherein pressing arms typically move in a pivotal manner.

These and other objects, features and advantages of the invention will occur to those skilled in the art to which the invention is addressed, in the light of the accompanying drawings and following description.

DETAILED DESCRIPTION OF THE PREFERRED EMBODIMENTS

Figure 1:
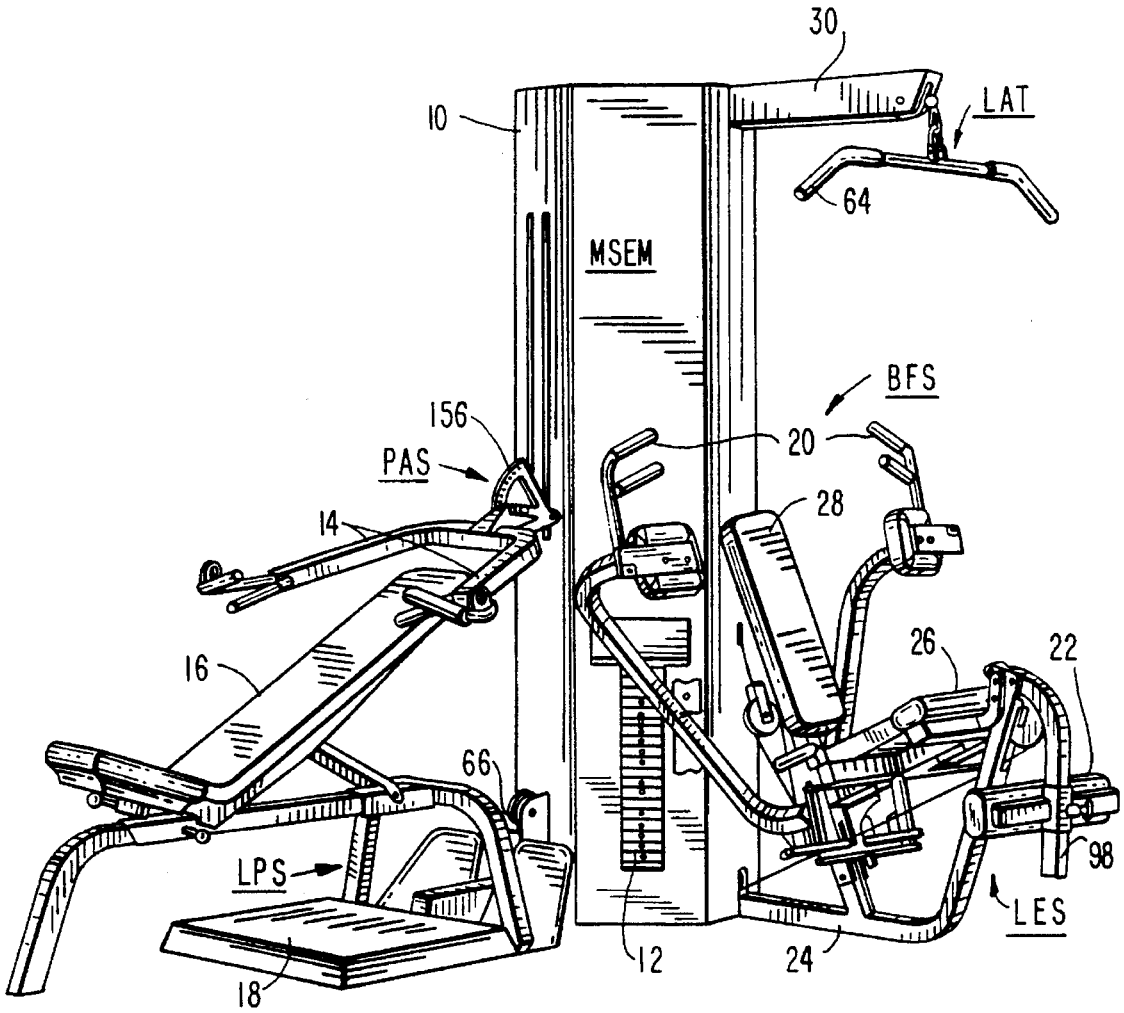
FIG. 1 is an isometric view of a typical multi-station exercise machine incorporating certain features of the present invention.
Figure 2:
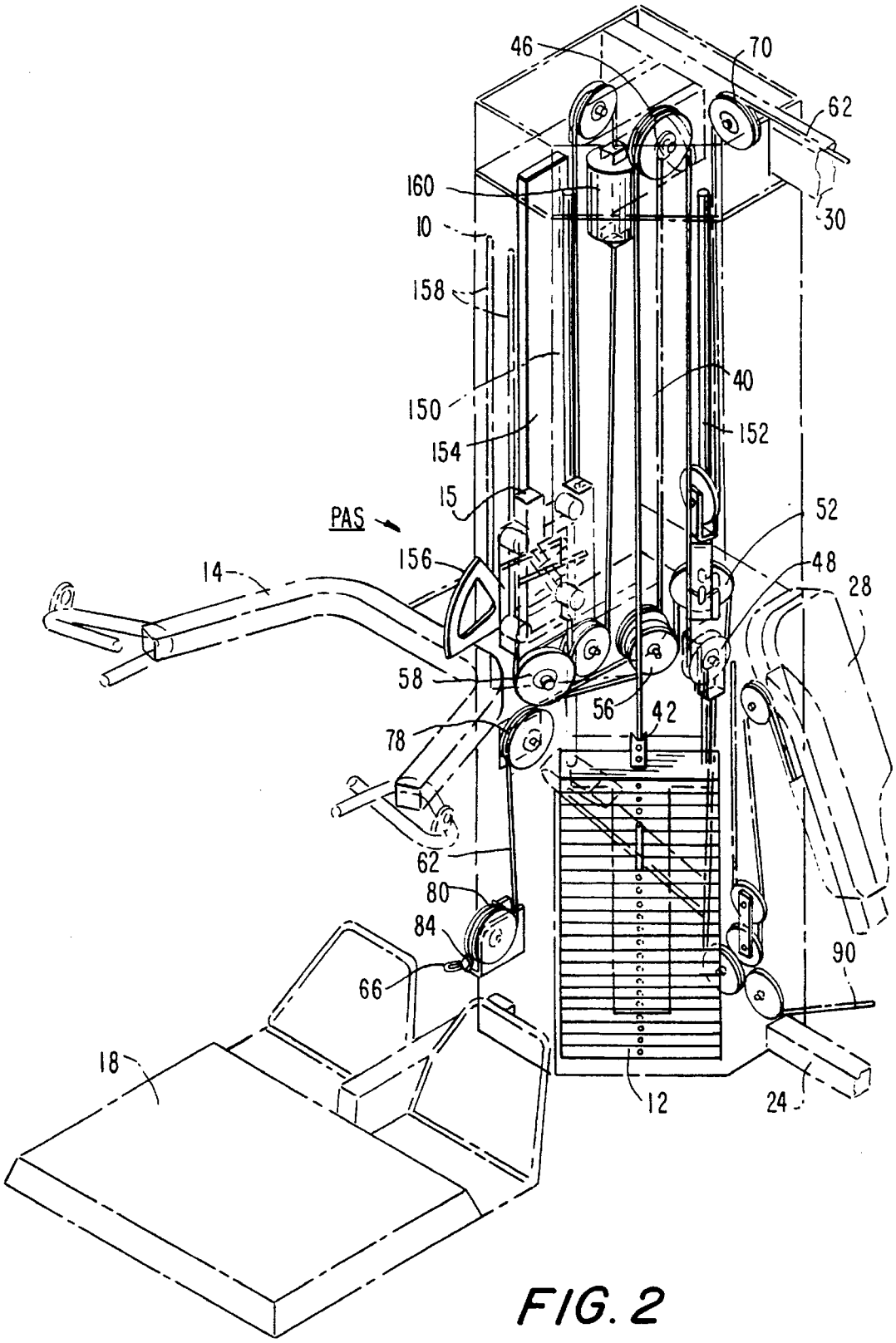
FIG. 2 is an isometric view with various parts shown in phantom to more clearly show the cable and pulley system of the machine shown in FIG. 1 as it relates to the pressing arm and lower pull stations thereof.
Figure 3:
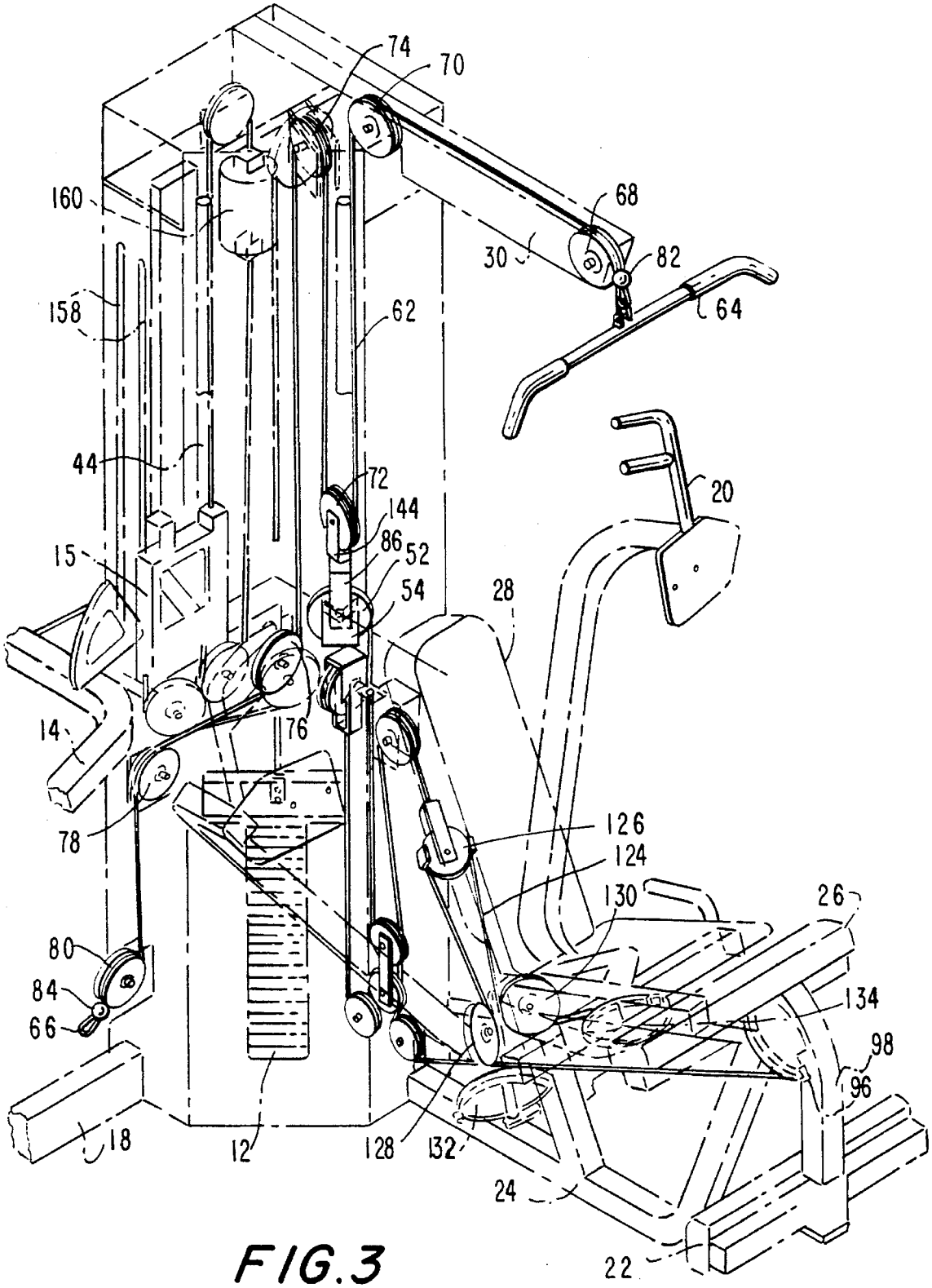
FIG. 3 is an isometric view with various parts shown in phantom to more clearly show the cable and pulley system of the machine shown in FIG. 1 as it relates to the fly station, leg extension station and the LAT pull-down station thereof.

The multi-station exercise machine MSEM shown in FIG. 1, with parts thereof further shown in FIGS. 2–5, in general comprises several exercise stations, the typical descriptive terminology for which in the art includes a pressing arm station generally indicated at PAS, a LAT pull-down station generally indicated at LAT, a butterfly or fly station generally indicated at BFS, a leg extension station generally indicated at LES, and a lower pull station at LPS.

Components of the machine shown in FIGS. 1–4 include in generally conventional fashion a stationary tower 10 housing in its lower portion a common weight stack 12, pressing arms 14, adjustable bench 16, platform 18, fly arms 20, shin cushion 22 on leg extension base 24, thigh cushion 26, back cushion 28, and upper beam 30.

As will be understood, the weight stack 12 can conventionally comprise a series of stacked weights, typically each weighing 10 pounds in the upper portion and each weighing 12.5 pounds in the lower portion, with the total weight selected from the stack being under the control of the user by placement of a selector pin (not shown).

As will also be understood, the machine components enumerated above are in general conventional per se and, accordingly, need not be further described except as they relate to the cable and pulley system of the machine, described below, as an embodiment of this invention.

The cable and pulley system of the exercise machine MSEM shown in FIGS. 1–5 comprises four pull cables. These cables and the associated pulleys can be understood most simply by reference to the diagrammatic showing thereof in FIG. 6, which showing is then related in the following description to the physical layout of these cables and pulleys in FIGS. 1–5.

The first pull cable involved is pull cable 40, attached at one end 42 thereof (FIG. 2) to the weight stack 12 and at the other end 44 to the pressing arms 14 through the pressing arms carriage 15, the course of the first pull cable 40 being over fixed shaft pulley 46, cradled pulley 48 supported by cradle 50, cradled pulley 52 supported by cradle 54, then over fixed shaft pulley 56 and fixed shaft pulley 58 to the end thereof at 44, with a stop element 60 being provided in association with the fixed axis pulley 58 to maintain the cable 40 under a desired degree of tension, i.e. without slack and with the pulleys 48, 52 maintained in their normally cradled positions on cradles 50, 54. In this embodiment, as indicated, the first pull cable 40 is that associated with the pressing station including pressing arms 14.

The second pull cable of the cable and pulley system of the machine MSEM shown in FIGS. 1–4 is pull cable 62, which is led from a high pull point at high pull bar 64 (FIGS. 1 and 3) to a low pull point 66 (FIGS. 1, 2 and 3), the course of such pull cable 62 being consecutively over fixed shaft pulleys 68, 70, floating shaft pulley 72, and fixed shaft pulleys 74, 76, 78, 80, with stop elements 82, 84 being associated with respective pulleys 68, 80 to maintain the cable 62 without slack and without substantial tension when not in use. As will be apparent, any pulling on either end component 64, 66 of this second pull cable 62 of sufficient force to overcome the tension on pull cable 40 will cause the floating shaft pulley 72, connected by U-shaped strap 86 to the cradled pulley 52, to move the cradled pulley 52 radially and consequently move the portion of the cable 40 between pulley 52 and the weight stack 12 lengthwise, resulting in the lifting of the selected number of weights in the weight stack 12.

The cable and pulley system of the exercise machine WSEM shown in FIGS. 1–5 comprises a third pull cable 90 which is connected at one end 92 to a U-shaped strap 94 which is in turn connected to the shaft 95 of cradled pulley 48 in the track of the first pull cable 40, and said third pull cable 90 terminates at its other end 96 on the movable arm 98 of the leg extension station LES. As shown in FIG. 6, the course of said third pull cable 90 is over fixed shaft pulley 100, cradled pulley 102 and fixed shaft pulley 104, with a stop element 106 being associated with the end 96 and pulley 104 of the pull cable 90 to maintain the pull cable 90 without slack but without substantial tension. As will be apparent, a pull applied to the cable 90 at the leg extension arm 98 of sufficient force to overcome the tension on the first pull cable 40 moves the cradled pulley 48 off its cradle 50 radially and moves that portion of cable 40 between pulley 48 and the weight stack 12 lengthwise so that the selected weights from the weight stack 12 are lifted.

The cable and pulley system of the exercise machine MSCM shown in FIGS. 1–4 further includes a fourth pull cable 110 which is led from an anchor 112 to the machine frame over floating shaft pulley 114, which is connected by straps 116 to the shaft 118 of the cradled pulley 102, then over a fixed shaft pulley 120 to a termination 122 connected to the fly arms 20 schematically indicated at 20 in FIG. 6 which, however, also includes, as shown in FIGS. 1–4, a further cable 124 reeved around a floating pulley 126 (FIG. 3) and respective fixed shaft pulley 128, 130 and cams 132, 134, then in turn connected to the fly arms 20, all in a manner conventional per se.

Figures 4, 5:
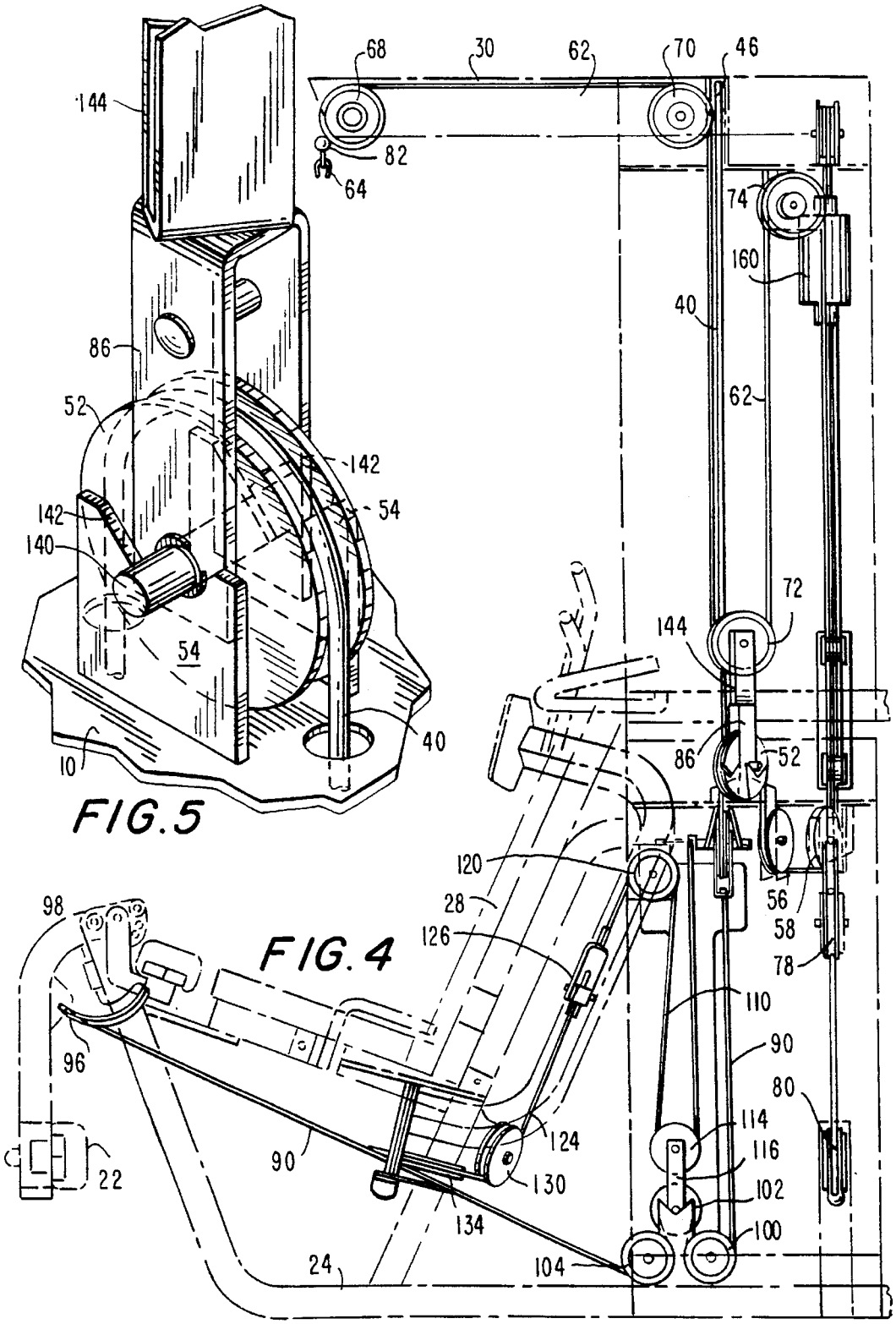
FIG. 4 is a side elevational view with various parts shown in phantom to more clearly show the cable and pulley system of the machine shown in FIG. 1 as it relates to the fly station and the LAT pull-down station thereof.
FIG. 5 is an enlarged detail view of one of the cradled pulleys of the cable and pulley system of the machine shown in FIGS. 1–4, with various parts shown in phantom for clarity of illustration to show further detail thereof.
Figure 6:
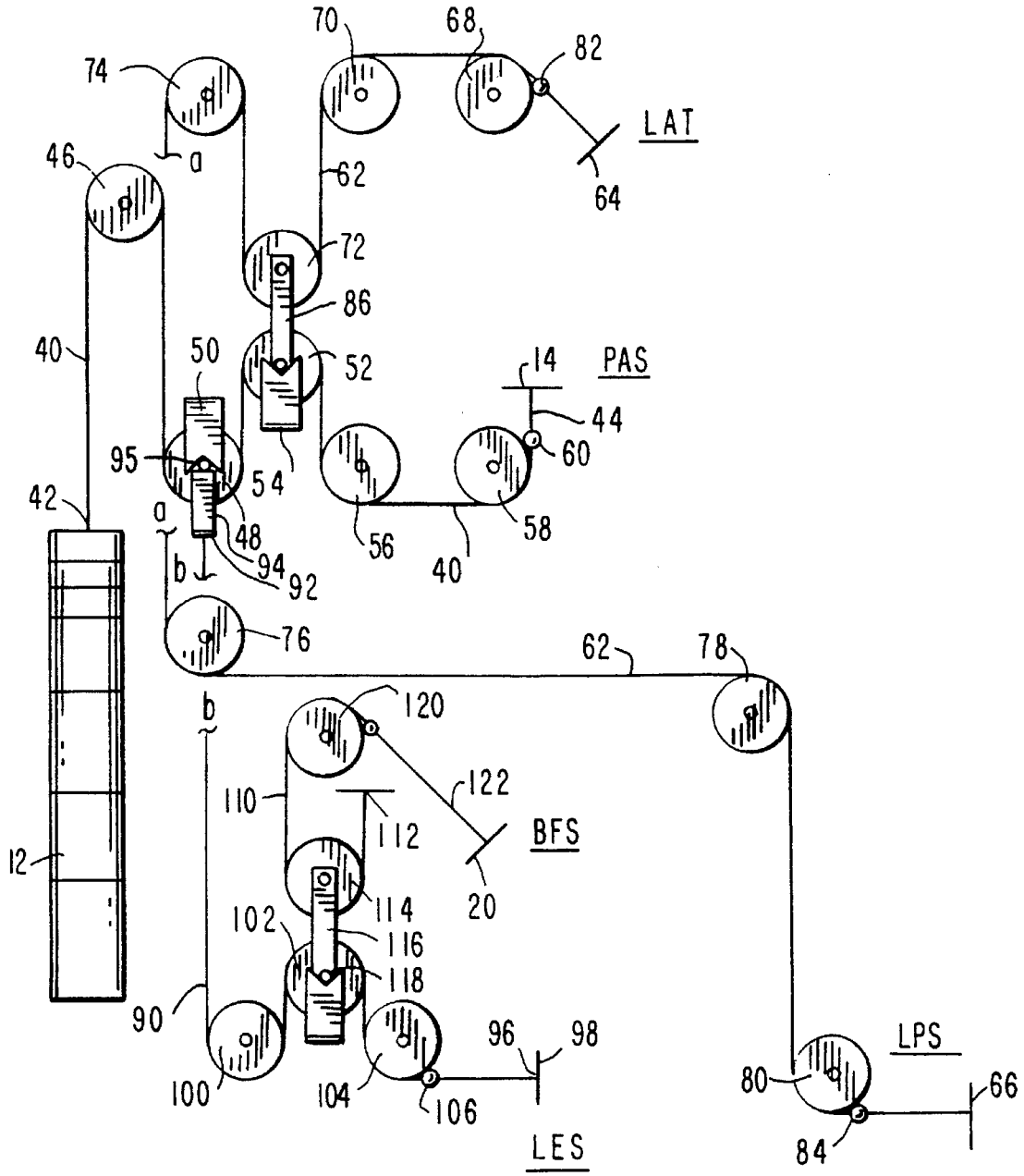
FIG. 6 is a schematic view of the significant components of the cable and pulley system utilized in the multi-station exercise machine shown in FIGS. 1–5.

FIG. 5 is a detailed isometric view on an enlarged scale, partly in phantom, illustrating a typical cradled pulley and associated interconnection with another pull cable which can function to lift the cradled pulley off its cradle and transmit movement of the connected cable to the first pull cable. As shown in FIG. 5, selecting cradled pulley 52 by way of example and showing it in cradled position on its cradle plate 54, its shaft 140, about which the rotating body of the pulley 52 rotates, is lodged or nested in the notched portions 142 of the cradle plate 54. U-shaped strap 86 spans the body of pulley 52 and in its lower portions encircles the shaft 140, and functions to mechanically interconnect the pulley 52 with the interconnecting portion of the other pull cable. In the instance illustrated, the U-shaped strap 144 of pulley 72 (FIG. 3) about which the second pull cable 62 is reeved, interconnects the two pull cables 40, 62.

Other mechanical details shown in the drawings, although not functionally essential to the cable and pulley system shown as the embodiment of the invention in FIGS. 1–6, include vertical guide rods 150, 152 extending generally top to bottom in the tower 10 and along which the selected number of weight components move under the pull of pull cable 40, and a vertically extending bar 154 of rectangular cross section, along which wheeled carriage 15 tracks upon movement of the press arms 14, which movement is in a manner with the arms moving in a parallel manner, as distinguished from the more conventional pivotal movement of such arms, it being an advantage of such parallel movement that the resistance encountered by the user over the course of travel of the arms is somewhat more uniform. Also as part of the machine and in particular the pressing section PAS thereof, is a triangular shaped bracket 156 which comprises a series of holes (FIG. 1) through which by pin insertion the user can adjust the angular attitude of the press arms 14 relative to the tower 10. Also, as will be apparent in FIGS. 1–3, the arms 14 and associated structure are interconnected with the carriage 15 through parallel vertical slots 158 in the tower 10. Yet a further detail in connection with the pressing station PAS is the provision in the length of the pull cable 40 of a counterweight 160 (not shown in FIG. 6) which serves to offset the dead weight of the press arms 14 and the associated carriage 15 so that the resistance encountered by the user when moving the press arms 14 is essentially the net amount of weight provided by the portion of the weights selected from the weight stack 12.

Figure 7:
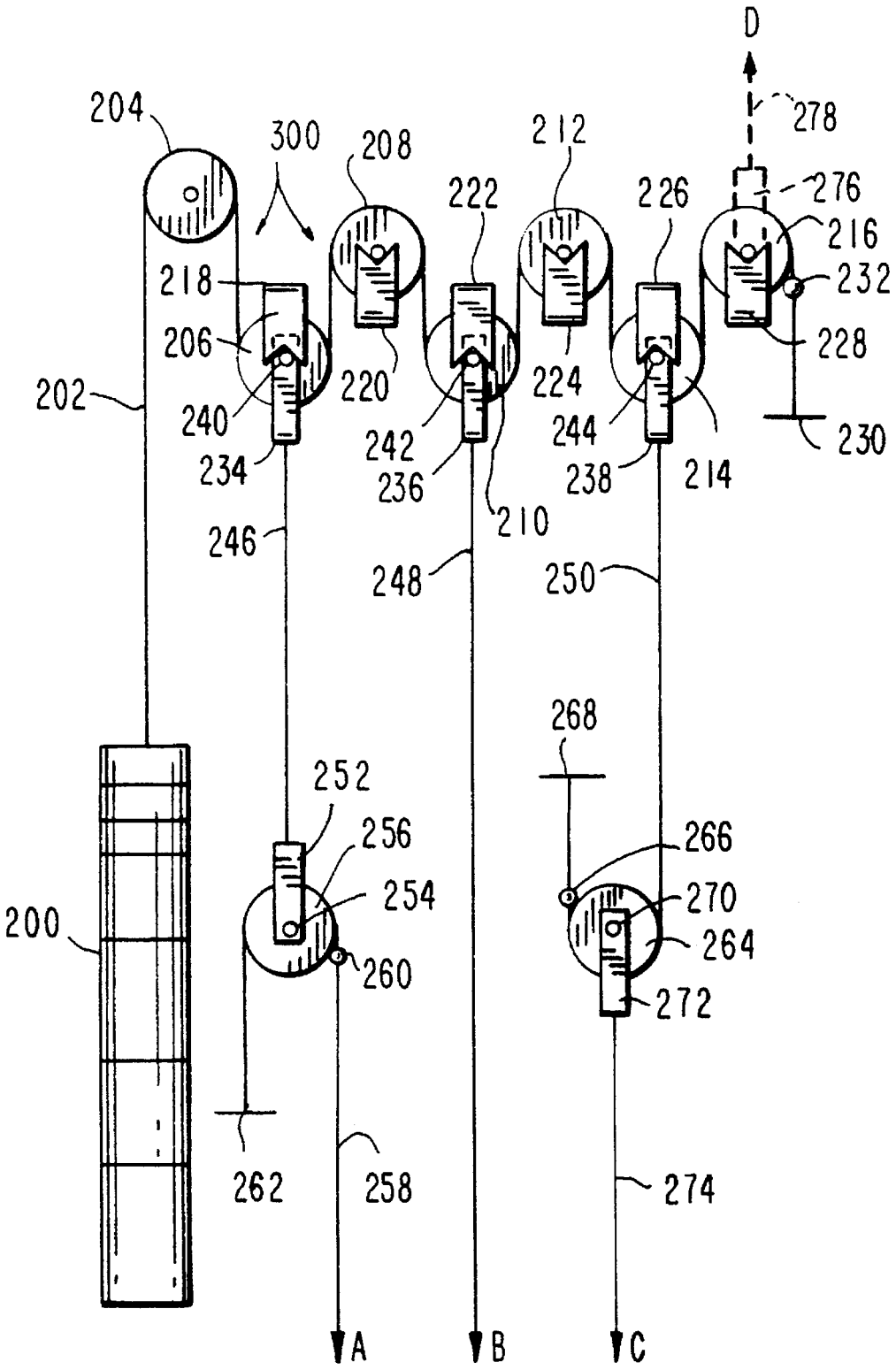
FIG. 7 is a schematic diagram of modified forms of cable and pulley systems according to the present invention, further illustrating certain of the concepts involved.

FIG. 7 is a schematic showing of certain modified forms of cable and pulley systems possible according to the present invention. In FIG. 7 the weight stack 200 has led thereto a tensioned cable 202 which is located along a path 300, reeved around a fixed pulley 204 and then a series of cradled pulleys 206, 208, 210, 212, 214, and 216 cradled in respective cradle mounts 218, 220, 222, 224, 226, 228, and then led to a stationary anchor 230 which can alternatively be the pull point of an exercise station if desired. If used as a pull point, a stop 232 should be attached to the end of the cable 202. As the cable 202 is displaced along or from the path 300, such as by movement of the cradle pulleys or the anchor, the weight stack is displaced.

Each of the cradled pulleys 206, 210, 214 has associated with it a respective U-shaped connector or linkage 234, 236, 238 interconnecting the respective pulley shaft 240, 242, 244 with a respective pull cable 246, 248, 250. Pull cable 246 is connected through U-shaped linkage 252 and shaft 254 of pulley 256 and then through pull cable 258 to an exercise station schematically designated at A, with the cable 258 carrying a stop element 260 and being terminated at its other end at a stationary anchor point on the machine frame as designated at 262. Pull cable 248 in the diagrammatic presentation of FIG. 7 connects directly to a second exercise station schematically designated at B. Pull cable 250, as shown in the diagram of FIG. 7, is reeved around pulley 264, carries a stop element 266, and leads to a stationary anchor point 268 on the machine frame. The pulley 264 of this arrangement has its shaft 270 carried by a U-shaped linkage 272 connecting it with pull cable 274 which terminates at an additional exercise station schematically designated at C.

As will be evident, the cable and pulley arrangement leading to exercise station A involves applying force to pull cable 258. This arrangement, along with the arrangement of the cradled pulley 206 in the track of the tensioned cable 202 provides a 2:1 resistance ratio at pulley 256, and a 1:2 resistance ratio at pulley 206. The resulting resistance ratio between the pull movement at the exercise station A and the movement of the weight in the weight stack 200 is a ratio of 1:1. In this respect, it is notable that a 1:1 resistance ratio is often desired for exercise station applications such as pressing stations, shoulders/bench stations and squat stations. Cable 248 which transmits movement at exercise station B to the cradled pulley 210, since it acts directly on the pulley 210, provides a resistance ratio of 1:2 between movement at the exercise station and movement of the weight in the weight stack 200. This ratio of resistance is typically used, for example, for leg extension stations, at which type of station it is common practice to provide a small cam to give the user an advantage at the end of the exercise pull.

The cable pull arrangement associated with exercise station C applies movement of the pull cable 274 led from the station to the pulley shaft 270 and consequently the pulley 264, and in turn to the pull cable 250 and the cradled pulley 214. By this arrangement, with the pulls applied to the pulley shafts 270, 244, the resistance ratio is 1:4, with a 1:2 step-up at pulley 264 and a second 1:2 step-up at pulley 214. Thus, one increment of movement of the pull cable 274 at the exercise station C results in four increments of movement of the weight at the weight stack 200. This order of resistance ratio is usable in applications such as a wrist roller exercise station, for example.

As also demonstrated in FIG. 7, additional cradled pulleys 208, 212, 216 are provided in the track of the tensioned cable 202 and are not otherwise employed in cable and pulley arrangements discussed in connection with exercise stations A, B and C. However, as will be evident, additional stations can be readily added to this system simply by connection of an additional cable arrangement to any of the additional cradled pulleys 208, 212, 216, such as those associated with exercise stations A, B or C, as indicated by broken line at linkage 276 and cable 278, to add to the machine an additional exercise station schematically indicated at D, for example. Such addition does not require any disconnection, change or alteration of any of the cable and pulley arrangements of any of the other exercise stations.

From the foregoing, various further alterations, variations and modifications of cable and pulley arrangements and machine and exercise station layout will readily occur to those skilled in the art to which the invention is addressed, within the scope of the following claims.

What is claimed is:

1. A cable tension isolation mechanism for use in a multi-station exercise machine having a frame, a resistance mechanism, a first input member adapted to engage a body part of a user attached to the resistance mechanism by a primary cable and a second input member adapted to engage a body part of a user attached to the resistance mechanism by a secondary cable, the isolation mechanism comprising:

cradle plates mounted to the frame and disposed proximate the primary cable wherein notches are disposed in the plates;

a shaft selectively seated in the notches;

a cradle pulley rotatably mounted to the shaft, wherein the primary cable is reeved over the cradle pulley opposite the cradle plates; and a strap attached to the shaft and extending away from the cradle plates wherein the secondary cable is attached to the strap.

2. The cable tension isolation mechanism of claim 1 wherein the notches are angled to direct the shaft to a seated position.

3. The cable tension isolation mechanism of claim 1 wherein the notches have a V-shape.

4. The cable tension isolation mechanism of claim 1 wherein the multi-station exercise machine comprises a third input member adapted to engage a body part of a user attached to the resistance mechanism by a tertiary cable, the isolation mechanism further comprising:

secondary cradle plates mounted to the frame and disposed proximate the primary cable wherein secondary notches are disposed in the secondary cradle plates;

a secondary shaft seated in the secondary notches;

a secondary cradle pulley rotatably mounted to the secondary shaft, wherein the primary cable is reeved over the cradle pulley opposite the secondary cradle plates; and a secondary strap attached to the secondary shaft and extending away from the cradle plates wherein the tertiary cable is attached to the strap.

5. The cable tension isolation mechanism of claim 1 wherein the cradle plates comprise at least two cradle plates disposed at opposite sides of the primary cable.

6. A multi-station exercise machine comprising:

a frame;

a weight stack mounted to the frame, the weight stack being displacable from a rest position to an elevated position;

a first cable attached to the weight stack and to the frame;

a cradle mounted to the frame and disposed proximate to the first cable when the weight stack is in the rest position;

a cradle pulley having an extended shaft which shaft is selectively seated in the cradle and wherein the first cable is reeved on the pulley and disposed opposite the cradle;

a second cable attached to the cradle pulley and extending away from the cradle wherein the cradle pulley is maintained in position by only the first cable, the second cable and the cradle; and a first input mechanism, adapted to engage a body part of a user, mounted to the second cable distal to the cradle pulley.

7. The multi-station exercise machine of claim 6 wherein notches are disposed in the cradle and are angled to direct the shaft to a seated position in the cradle.

8. The multi-station exercise machine of claim 6 wherein the first cable is selectively attached to the frame and further comprising a second input mechanism adapted to engage a user's body part, which second input mechanism is operably engaged to the first cable.

9. The multi-station exercise machine of claim 6 further comprising:

a second cradle mounted to the frame and disposed proximate to the first cable when the weight stack is in the rest position;

a second pulley selectively seated in the second cradle wherein the first cable is reeved on the second pulley and disposed opposite the second cradle; and a third cable attached to the second pulley and extending away from the second cradle.

10. The multi-station exercise machine of claim 9 wherein the second pulley has an extended shaft and wherein notches are disposed in the second cradle.

11. The multi-station exercise machine of claim 10 further comprising a second mount adapted to engage a user's body part which second mount is operably engaged to the third cable.

12. An apparatus for exercising muscles of a user comprising:

a frame;

a primary cable having a first end and a second end wherein the first end is selectively connected to the frame;

a means for resisting displacement of the primary cable attached to the second end of the primary cable;

a stop mounted to the first end of the primary cable which is adapted to prevent movement of the first end in at least a first direction with respect to the frame;

a means for directing the primary cable from the resisting means to the frame along a path;

at least a first cradle plate mounted to the frame and disposed proximate the path of the primary cable;

a notch disposed in the cradle plate;

a cradle pulley disposed between the primary cable and the cradle plate wherein, when the primary cable is in the track, the cradle pulley is seated in the notch;

a means for engaging a body part of the user, the engaging means being selectively mounted to the frame; and a means for displacing the primary cable from the path by unseating the cradle pulley from the notch, wherein the displacing means is operably engaged to the engaging means.

13. The apparatus of claim 12 wherein the displacing means comprises a secondary cable attached to the cradle pulley.

14. The apparatus of claim 13 wherein the cradle pulley comprises a shaft and the secondary cable is attached to the shaft by a strap.

15. The apparatus of claim 13 further comprising a secondary stop attached to the secondary cable to prevent displacement of the secondary cable with respect to the frame in at least one direction.

16. The apparatus of claim 12 wherein the cradle pulley comprises a shaft and wherein the shaft is seated in the notch.

17. The apparatus of claim 16 wherein the notch has a V-shape and directs the shaft to a seated position.

18. The apparatus of claim 12 wherein the primary cable directing means comprises pulleys rotatably mounted to the frame.

19. The apparatus of claim 12 wherein the resisting means comprises a weight stack.

20. The apparatus of claim 12 further comprising:

a second cradle plate mounted to the frame and disposed proximate the path of the primary cable;

a second notch disposed in the second cradle plate;

a second cradle pulley disposed between the primary cable and the second cradle plate wherein, when the primary cable is in the path, the second cradle pulley is seated in the second notch;

a second means for engaging a body part of the user displaceably mounted to the frame; and a second means for displacing the primary cable from the path by unseating the second cradle pulley from the second notch, wherein the second displacing means is operably engaged to the second engaging means.

* * * * *